US006594920B2

(12) United States Patent
Pizzamiglio et al.

(10) Patent No.: US 6,594,920 B2
(45) Date of Patent: Jul. 22, 2003

(54) SKI BOOT WITH VARIABLE VOLUME SHELL

(75) Inventors: Maurizio Pizzamiglio, Montebelluna (IT); Silvio Quagliotto, Montebelluna (IT)

(73) Assignee: Lange International S.A., Geneva (CH)

( * ) Notice: Subject to any disclaimer, the term of this patent is extended or adjusted under 35 U.S.C. 154(b) by 0 days.

(21) Appl. No.: 09/896,332

(22) Filed: Jun. 29, 2001

(65) Prior Publication Data

US 2002/0004997 A1 Jan. 17, 2002

(30) Foreign Application Priority Data

Jul. 14, 2000 (CH) ..... 1388/00

(51) Int. Cl.[7] ..... A43B 5/04

(52) U.S. Cl. ..... 36/117.6; 36/118.2; 36/10; 36/50.5

(58) Field of Search ..... 36/117.6, 118.2, 36/10, 50.5

(56) References Cited

U.S. PATENT DOCUMENTS

| | | | | | |
|---|---|---|---|---|---|
| 3,786,580 | A | * | 1/1974 | Dalebout | 36/117.6 |
| 3,793,747 | A | * | 2/1974 | Mochizuzuki | 36/118.2 |
| 4,078,322 | A | * | 3/1978 | Dalebout | 36/10 |
| 4,499,675 | A | * | 2/1985 | Perotto | 36/10 |
| 4,910,889 | A | * | 3/1990 | Bonaventure et al. | 36/117.6 |
| 4,920,666 | A | * | 5/1990 | Marega | 36/10 |
| 5,174,050 | A | * | 12/1992 | Gabrielli | 36/10 |
| 5,509,217 | A | * | 4/1996 | Condini | 36/10 |
| 5,647,150 | A | | 7/1997 | Romanato et al. | |
| 5,787,611 | A | | 8/1998 | Bonaventure | |
| 5,832,635 | A | * | 11/1998 | Finney et al. | 36/115 |
| 5,839,735 | A | * | 11/1998 | Benoit | 36/50.5 |
| 6,021,589 | A | | 2/2000 | Cagliari et al. | |

FOREIGN PATENT DOCUMENTS

| | | |
|---|---|---|
| DE | 83 36 239 | 12/1883 |
| DE | 297 19 568 U | 12/1997 |
| EP | 0583 565 A1 | 6/1993 |
| EP | 0683 991 A1 | 5/1995 |
| EP | 0 754 412 A | 1/1997 |

OTHER PUBLICATIONS

International Search Report in SN CH 13882000.

* cited by examiner

*Primary Examiner*—Ted Kavanaugh
(74) *Attorney, Agent, or Firm*—Bugnion S.A.; John Moetteli

(57) ABSTRACT

The top of the shell (2) made of molded plastic forms part of a flexible upper (1) in which a longitudinal opening line (9) forming a flap (12) is formed. The front lateral side of this flap is connected to the upper by an extensible elastic part (15). Good forward waterproofing is hence obtained without using a seal.

18 Claims, 4 Drawing Sheets

SKI BOOT WITH VARIABLE VOLUME SHELL

FIELD OF THE INVENTION

The present invention relates to a ski boot comprising a variable-volume shell which is at least partially made of molded plastic and is divided, by a longitudinal opening line, into an outer side and an inner side, one of these sides having a flap that has a front lateral side and a back lateral side, this flap being applied onto the other side when the boot is being closed.

PRIOR ART

Modem variable-volume ski boots comprise a shell which closes over the foot by two flaps that are applied onto one another by closing and tightening means. The front ends of these flaps define a transverse slot in the forward part of the shell to allow the flaps to be opened, so as to make it easier to insert the foot into the boot. To make the shell waterproof at the location of this slot, a seal is generally arranged on an area of the shell extending under the ends of the flaps. This seal also generally has a continuation extending beyond the ends of the transverse slot, to ensure proper waterproofing at the ends of the slot. However, even in the compressed state, it is found that such a seal does not fully prevent the water from entering at the particularly exposed front end of the flaps. This is due to the surface discontinuity appearing at the lateral edge of the low flap covered by the high flap. This discontinuity creates a space which is never completely occupied by the rubber of the seal since the latter, even when pliable, cannot deform enough to completely block entry to this space.

The use of a synthetic foam that has open cells and is therefore highly compressible does not make it possible to improve the waterproofing, because it is found that moisture penetrates the foam by a pumping effect, then subsequently penetrates inside the shell. Utility model DE 83 36 239 has proposed to use a piece of elastic material having ribs next to the flaps, the elastic compression of these ribs by the flaps being supposed to provide better waterproofing. This improvement does not, however, make it possible to solve the problem mentioned above.

Patent EP 0 583 565 describes a sealing piece having two wings, one of these wings extending under the low flap and to the front of it, while the other wing extends between the two flaps. The waterproofing is indeed improved toward the front, but a discontinuity is formed at the rear, below the instep. Further, at the front, the raising of the high flap creates snow retention that compromises the waterproofing. This thickening of the high flap also causes lateral discomfort.

The design described in utility model DE 297 19 568 has proposed to improve the waterproofing by eliminating the transverse slot on one of the sides of the longitudinal opening line, so that there is essentially only a single flap. The remaining transverse slot is closed by a seal having a variable profile. The problems inherent in the presence of a compressible seal remain. Document EP 0 683 991 proposes a design without a seal. As in the case mentioned above, the variable-volume shell is provided with a single flap whose front end is continued by a tab that covers almost all of the forward part of the opening line. In this case, the waterproofing is provided by applying this tab onto the shell. It is obvious that this type of closure is not completely waterproof. An uncovered transverse slot is also left. The waterproofing can be improved by covering this tab with an extension of a closing strap.

U.S. Pat. No. 6,021,589, in the name of the Applicant, moreover discloses a ski boot comprising a flexible upper in the form of a sock, enclosed by a frame in the form of an open hoop fixed to the flexible upper by a plastic injected around the frame and through the open sole.

SUMMARY OF THE INVENTION

The present invention draws on this last design to provide waterproofing at the flap without an auxiliary seal.

The boot according to the invention is more precisely distinguished by the fact that the top of the boot, in which the flap is formed and in which the longitudinal opening line is located, forms part of a flexible upper that is enclosed, in its low part, by the molded plastic part, and in that the front lateral side of the flap is connected to the upper by an extensible elastic part.

The extensible elastic part is preferably made of elastic, more precisely bi-elastic, fabric.

According to a preferred embodiment of the invention, the high part of the flexible upper, intended to enclose the ankle, is also connected to the flap and to the part on the opposite side from the flap by extensible elastic parts.

BRIEF DESCRIPTION OF THE DRAWINGS

The appended drawing represents, by way of example, an embodiment of the boot according to the invention.

DESCRIPTION OF THE PREFERRED EMBODIMENT

Figure 1:
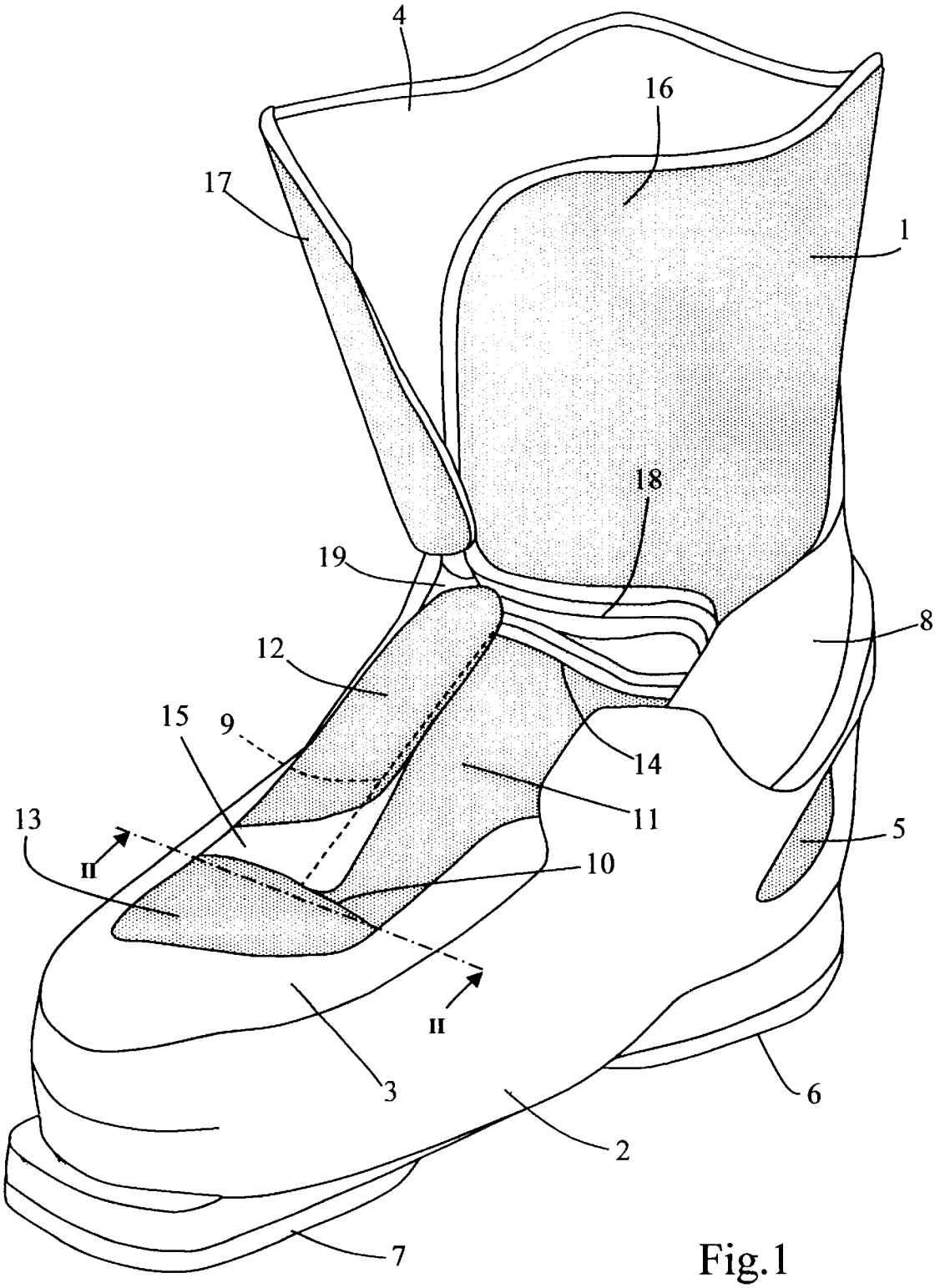
FIG. 1 represents a perspective view thereof without a cuff or buckles.
Figure 2:
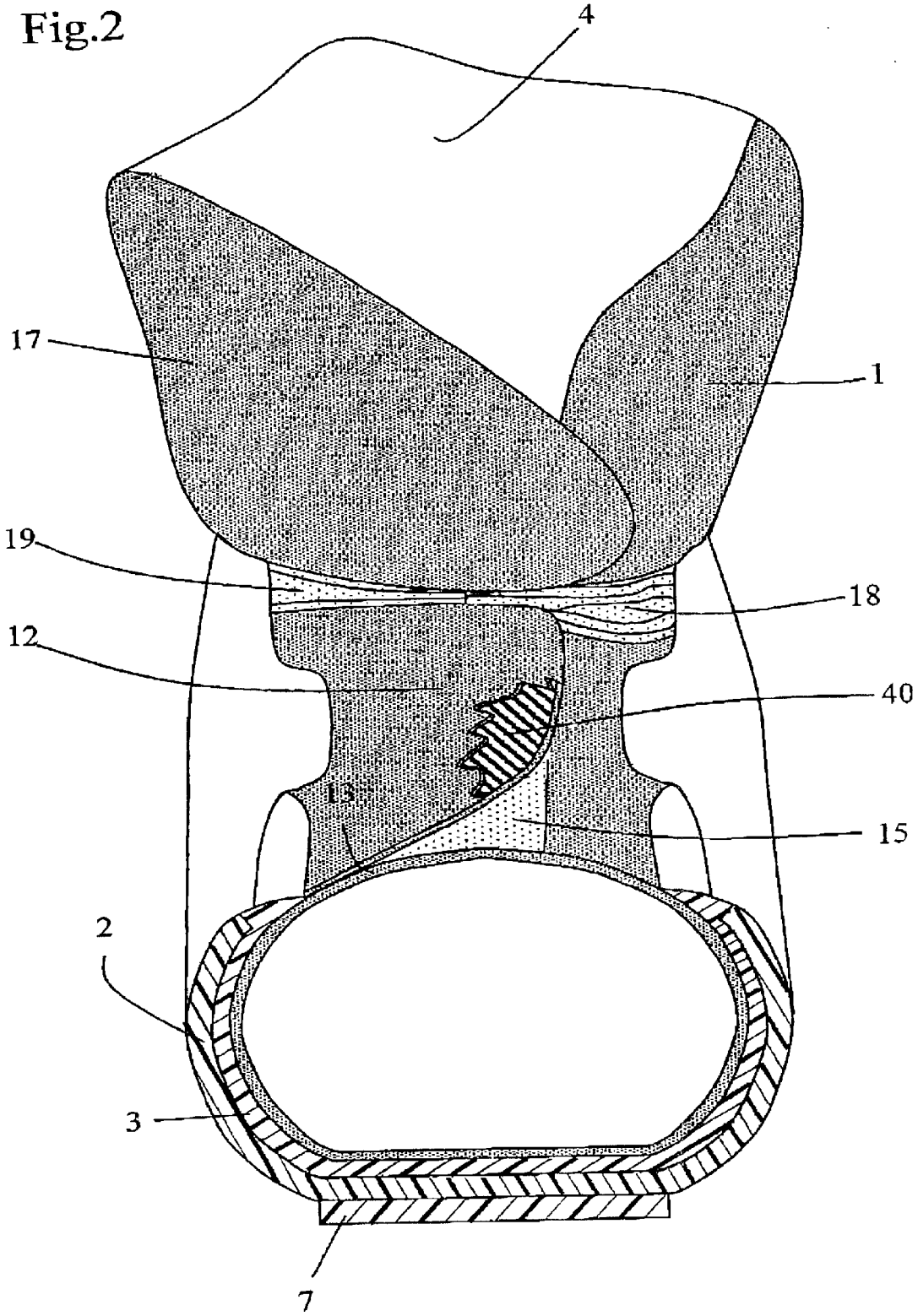
FIG. 2 is a view in section on II—II of FIG. 1.

The represented boot consists of a flexible upper 1 in the form of a sock that opens on the front, and of a shell 2 injected from relatively rigid plastic, the upper 1 and the shell 2 being secured by injecting, from below, a flexible plastic 3 injected between the flexible upper 1 and the shell 2 as described in U.S. Pat. No. 6,021,589. The upper 1 essentially consists of a textile material. In its high part intended to enclose the lower leg, the upper 1 is lined with plastic 4. The shell 2 has holes such as 5 that are intended to reduce its weight. The upper 1 can be seen through the hole 5. The flexible plastic 3 forms an intermediate region between the edge of the shell 2 extending over the top of the foot and the upper 1. In the known way, the sole is provided at the rear with a heel 6 made of hard rubber and at the front with a corresponding plate 7 made of the same material.

A cuff (not shown) is articulated to the shell 2 in the regions 8 and two buckles are fixed on the shell 2, to the front of the region 8.

In the part of the upper 1 extending over the foot, it has a longitudinal opening line 9 that stops on a transverse line 10.

The opening line 9 divides the top of the upper 1 into two flaps 11 and 12. The front end of the flap 11 is entirely connected to the part 13 of the upper extending to the front of the transverse line 10, so that only the back side 14 of the flap 11 has a degree of freedom. At the transverse line 10, the boot therefore behaves as if it had only a single flap 12. This flap 12 is connected to the transverse line 10 by a bi-extensible elastic material 15 such as LYCRA (registered trademark). The flap 12 intended to be applied onto the flap 11 and to receive the pressure of the buckles is lined with foam, and the elastic material 15 extends under the flap while forming a lining.

The part of the upper intended to enclose the lower leg is cut out so as to form two flaps 16 and 17. The flap 16 is connected to the flap 11 by a bi-elastic fabric 18 identical to the material of the part 15. Likewise, the flap 17 is connected to the flap 12 by a bi-elastic part 19 of the same material as the parts 15 and 18.

The elastic parts 15, 18 and 19 make it possible to have relatively very wide flaps 12, 16 and 17, and consequently permit a large opening for putting the boot on, while ensuring that the upper is continuous on each side of the opening line, hence ensuring that the boot is properly waterproof. The boot hence combines comfort, when putting it on and taking it off, with the waterproofing.

Figure 3:
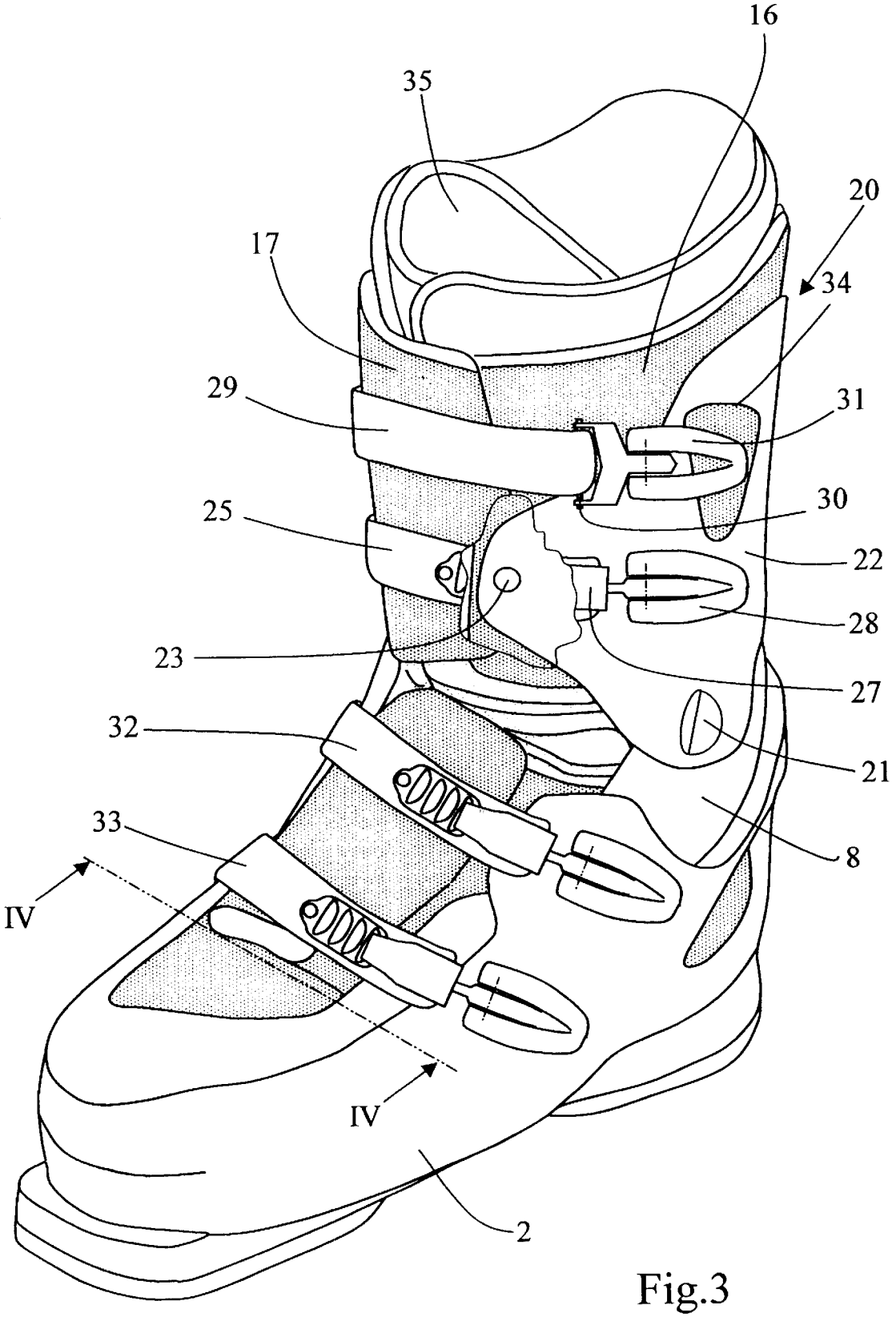
FIG. 3 represents the complete boot.
Figure 4:
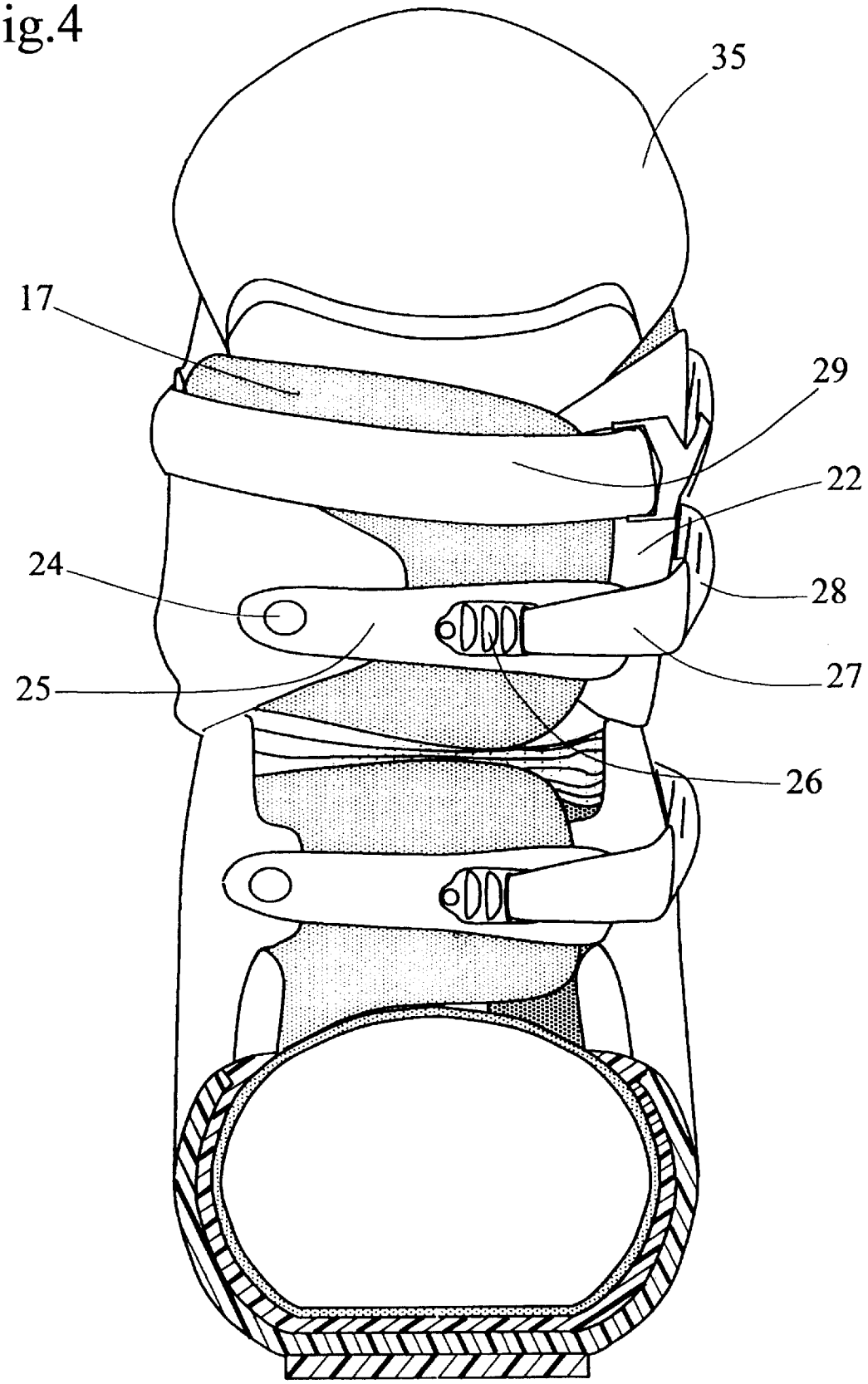
FIG. 4 is a view in section on IV—IV of FIG. 3.

The complete boot is represented in FIGS. 3 and 4. It comprises a cuff 20 that is articulated in the regions 8 of the shell 2 at two opposite points located on a straight line transverse to the boot, one of these points, 21, being visible in FIG. 3.

The cuff 20 partly consists of the flaps 16 and 17 of the flexible upper 1. More precisely, the cuff 20 consists partly of a piece 22 of semirigid plastic that only partially encloses the upper, that is to say the leg when the boot is closed, and partly of the flaps 16 and 17. The semirigid plastic part 22 is fixed to the flap 16 by a rivet 23, and to the flap 17 by a rivet 24 that is simultaneously used as an attachment point for a strap 25 carrying a rack 26 on which a hook 27 engages, the hook 27 forming part of a buckle comprising a tensioning lever 28 mounted on the semirigid plastic part 22. It can be seen in the drawing that the height of the semirigid part 22 of the cuff decreases when going forward from the sides of the cuff. The front ends of the semirigid part 22 of the cuff are therefore not stacked, as is the case with the cuffs according to the prior art made entirely of semirigid plastic, rather the cuff is closed by the flexible flaps 16 and 17 so that the cuff encloses and tightens the leg while fitting better to the morphology of the leg, without causing any painful localized pressure. The flexibility of the flaps 16 and 17 also makes it possible to open the cuff more easily and completely for putting the boot on and taking it off. It can be seen that the flexible flap 17, i.e. the flap corresponding to the inner side of the foot, covers, on the front of the cuff, the semirigid plastic part 22 when the boot is closed, as is visible in FIG. 4. In FIG. 3, the overlapping part has been removed to show the shape of the semirigid part and the rivet 23.

Instead of using, for the flexible upper, a textile material lined with plastic in the high part comprising the flaps 16 and 17, it is possible to use another flexible material such as natural or imitation leather or any other flexible material.

The means for closing and tightening the boot also comprise a strap 29, one end of which is fixed on the inside of the cuff 20 on the semi-rigid part 22, this strap passing over a bar 30 of a buckle 31 then being fixed to itself by a Velcro (registered trademark) fastener. The closing and tightening means also comprise two buckles with straps 32 and 33 similar to the strap 25.

The semi-rigid plastic part 22 of the cuff could extend over a part of the periphery of the cuff below the part represented in the drawing. The part 22 can be open as represented at 34. Comfort padding 35 can also be seen in the drawing.

What is claimed:

1. A ski boot comprising a composite variable-volume shell having a bottom molded-plastic portion (2) and a flexible top portion, the shell being divided, by a longitudinal opening line (9), into an outward side corresponding to an external side of a foot and a medial side corresponding to a medial side of the foot, one of these sides having a flap (12) which closes against the other side (11), wherein the top portion of the shell, to which the flap is connected and in which the longitudinal opening line is located, forms part of a flexible upper (1) that is enclosed, in its lower portion, by the molded plastic portion (2), and wherein a front laterally extending edge of the flap (12) is connected to the upper by an intermediary extensible elastic part (15).

2. The boot as claimed in claim 1, wherein the top portion of the flexible upper (1), intended to enclose the lower leg, is also connected to the flap (12) and to the part (11) against which the flap closes by second intermediary extensible elastic parts.

3. The boot as claimed in claim 1 or 2, wherein the extensible elastic parts are made of fabric.

4. The boot as claimed in one of claims 1 to 3, wherein the flexible upper (1) is made of textile material.

5. The boot as claimed in claim 4, wherein the flap (12) is lined with foam.

6. The boot as claimed in claim 4 or 5, wherein the high part of the upper is lined with an impermeable material (4).

7. The boot as claimed in one of claim 1 to 6, wherein the extensible parts (15) extend under the flap (12).

8. A ski boot comprising:

a shell comprising a relatively rigid lower portion of the boot, intended to partially cover the foot and the ankle;

a flexible top portion made of a relatively thick material the top portion connected to and extending from the rigid lower portion and forming two large overlapping flaps on a front of the top portion for closing the top portion; and a partial cuff made of semi rigid plastic by which the top portion is articulated to the rigid lower portion at two opposite points located on a straight line transverse to a long axis of the boot and which tightens around the top portion by straps that close around the flaps, the flaps and the partial cuff cooperating in order to form a full, composite cuff by virtue of the large flaps which press against each other and spaced-apart strap connection points that permit wide adjustability, the composite cuff rigidizing the top portion around ankles of various morphology.

9. The boot as claimed in claim 8, in which the flap of the upper, which flap is located on the side of the boot corresponding to the inner side of the foot, closes against the plastic part of the cuff.

10. The boot as claimed in claim 8, in which the semirigid part of the cuff partially encloses the upper when the boot is closed.

11. The boot as claimed in claim 10, in which the height of the semirigid part of the cuff decreases starting from the sides of the cuff in the forward direction.

12. The boot as claimed in claim 8, in which the semirigid part of the cuff carries means for closing the cuff.

13. The boot as claimed in claim 8, in which the flexible top portion of the composite shell itself forms a complete upper whose lower portion is enclosed by the rigid lower portion of the composite shell.

14. The boot as claimed in claim 8, in which the flexible portion is made of textile material.

15. The boot as claimed in claim 8, in which the flexible portion is made of leather.

16. The boot as claimed in claim 8, in which the flexible portion is made of synthetic material.

17. The boot as claimed in claim 16, in which the flexible portion is made of imitation leather.

18. The boot as claimed in claim 8, in which the width of the partial, semi-rigid cuff decreases starting from the sides of the top portion in the forward direction.

* * * * *